US006667681B1

(12) United States Patent
Meiners et al.

(10) Patent No.: US 6,667,681 B1
(45) Date of Patent: Dec. 23, 2003

(54) NETWORK PROTECTOR FUSE HOUSING

(75) Inventors: Steven E. Meiners, Beaver Falls, PA (US); Arthur J. Jur, Aliquippa, PA (US); Michael F. Magazine, Carnegie, PA (US); Douglas M. Brandt, Ellwood City, PA (US); Stephen W. Oneufer, Cranberry Township, Butler County, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/214,076

(22) Filed: Aug. 7, 2002

(51) Int. Cl.[7] ..... H01H 85/02; H01H 85/20

(52) U.S. Cl. ..... 337/186; 337/187; 361/626

(58) Field of Search ..... 337/186, 187, 337/191, 227; 361/642, 104, 626, 837

(56) References Cited

U.S. PATENT DOCUMENTS

| | | | | | |
|---|---|---|---|---|---|
| 1,456,385 | A | * | 5/1923 | Kvarnstrom | 220/3.94 |
| 2,091,204 | A | * | 8/1937 | Horn | 337/188 |
| 2,186,813 | A | * | 1/1940 | Adam et al. | 337/210 |
| 2,289,122 | A | * | 7/1942 | Jackson et al. | 337/188 |
| 2,617,847 | A | * | 11/1952 | Cole | 439/621 |
| 3,032,629 | A | * | 5/1962 | Uecker | 335/23 |
| 3,043,934 | A | * | 7/1962 | Bodenschatz | 337/7 |
| 3,171,926 | A | * | 3/1965 | Schwab | 337/7 |
| 3,202,788 | A | * | 8/1965 | George | 337/194 |
| 3,274,356 | A | * | 9/1966 | Godfrey | 337/189 |
| 3,280,280 | A | * | 10/1966 | Gryctko | 337/6 |
| 3,418,615 | A | * | 12/1968 | Canney | 337/190 |
| 3,748,621 | A | * | 7/1973 | Sakats | 337/173 |
| 3,983,460 | A | | 9/1976 | Kuhn et al. | |
| 3,991,291 | A | * | 11/1976 | McGuffie et al. | 200/50.02 |
| 4,002,864 | A | * | 1/1977 | Kuhn et al. | 200/50.21 |
| 4,002,865 | A | * | 1/1977 | Kuhn et al. | 200/50.22 |
| 4,332,002 | A | * | 5/1982 | Yamaguchi et al. | 361/835 |
| 4,500,862 | A | * | 2/1985 | Shedd | 337/32 |
| 4,560,839 | A | * | 12/1985 | Dillard | 379/413.02 |
| 5,011,033 | A | * | 4/1991 | Roth | 220/3.94 |
| 5,179,503 | A | * | 1/1993 | Fouts et al. | 361/729 |
| 5,795,193 | A | * | 8/1998 | Yang | 439/621 |
| 5,820,413 | A | * | 10/1998 | Yamada et al. | 439/621 |
| 5,982,267 | A | * | 11/1999 | Locht | 337/186 |
| 5,995,380 | A | * | 11/1999 | Maue et al. | 361/826 |
| 2002/0031924 | A1 | * | 3/2002 | Davis et al. | 439/76.2 |

* cited by examiner

*Primary Examiner*—Anatoly Vortman
(74) *Attorney, Agent, or Firm*—Martin J. Moran

(57) ABSTRACT

A housing assembly for network protector fuses that includes a first and second C-shaped body and one or more cover plates. The first C-shaped body has a generally flat, rectangular front side and generally perpendicular first extension and second extension. The second C-shaped body has a generally flat, rectangular back side and generally perpendicular third extension and fourth. The first and second C-shaped bodies are coupled together forming an enclosure. The first body has one or more openings on the front side. The cover plates are coupled to the first C-shaped member and sealingly disposed over the openings in the first C-shaped body. The front side and the back side have a length sufficient to enclose more than one network protector fuse.

20 Claims, 11 Drawing Sheets

NETWORK PROTECTOR FUSE HOUSING

BACKGROUND OF THE INVENTION

1. Field of the Invention

This invention relates to a fuse housing for a network protector and, more specifically, to a fuse housing that is constructed using a reduced number of parts.

2. Description of the Prior Art

Secondary power distribution networks consist of interlaced grids which are supplied by two or more sources of power so that the loss of a single source of power will not result in an interruption of service. Such networks provide the highest level of reliability possible with conventional power distribution and are normally used to supply high-density load areas such as a section of a city, a large building, or an industrial site. Between the power sources and the network is a transformer and a network protector. Such network protectors are often found in dust-proof or moisture-proof housings which are disposed in subterranean passageways in large metropolitan areas. The housing, or "tank," may be further disposed within a concrete vault.

The network protector consists of a circuit breaker and a control relay. The control relay senses the transformer and network voltages and line currents and executes algorithms to initiate breaker tripping or closing action. The network protector is, typically, coupled to the line and the load by a three phase bus. Network protectors often utilize fuses as a secondary means of protection. Thus, there are fuses installed on each of the phases. Because interruption of a fuse inside the network protector housing often results in damage to the circuit breaker or other components, it is often preferable to have the fuses located outside of the network protector housing.

The fuses are enclosed in separate watertight housings disposed on top of the network protector housing. The prior art fuse housings are made from steel or molded fiber reinforced epoxy resin. The molded fuse housings are expensive. The steel fuse housings are less expensive, but are prone to leaks around the welded joints. Moreover, because each fuse has a separate housing, there are multiple welded joints that have the potential to leak. When water penetrates the fuse housing, the fuse may be damaged or degraded, thus limiting the ability of the fuse to interrupt the circuit.

There is, therefore, a need for an inexpensive fuse housing that is less prone to leakage.

There is a further need for a new fuse housing that is compatible with existing network protectors.

SUMMARY OF THE INVENTION

These needs, and others, are satisfied by the invention which provides a network protector fuse housing that is constructed using a two clam shell halves and which is structured to enclose all fuses connected to the network protector. The clam shell halves are constructed of stamped steel and have elongated U-shaped bodies. The U-shaped bodies are welded together to form the housing. Thus, there are eight welded joints on the housing. The number of welded joints is reduced relative to the prior art fuse housings which had at least eight welded joints on each of three individual housings.

The fuse housing may be mounted on the tank or, if space within the vault is an issue, on a wall adjacent to the network protector. The fuse housing may also have access portals located adjacent to each fuse, or, one large portal providing access to every fuse within the housing. The portal(s) is sealed with a cover that is coupled to the housing by fasteners.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
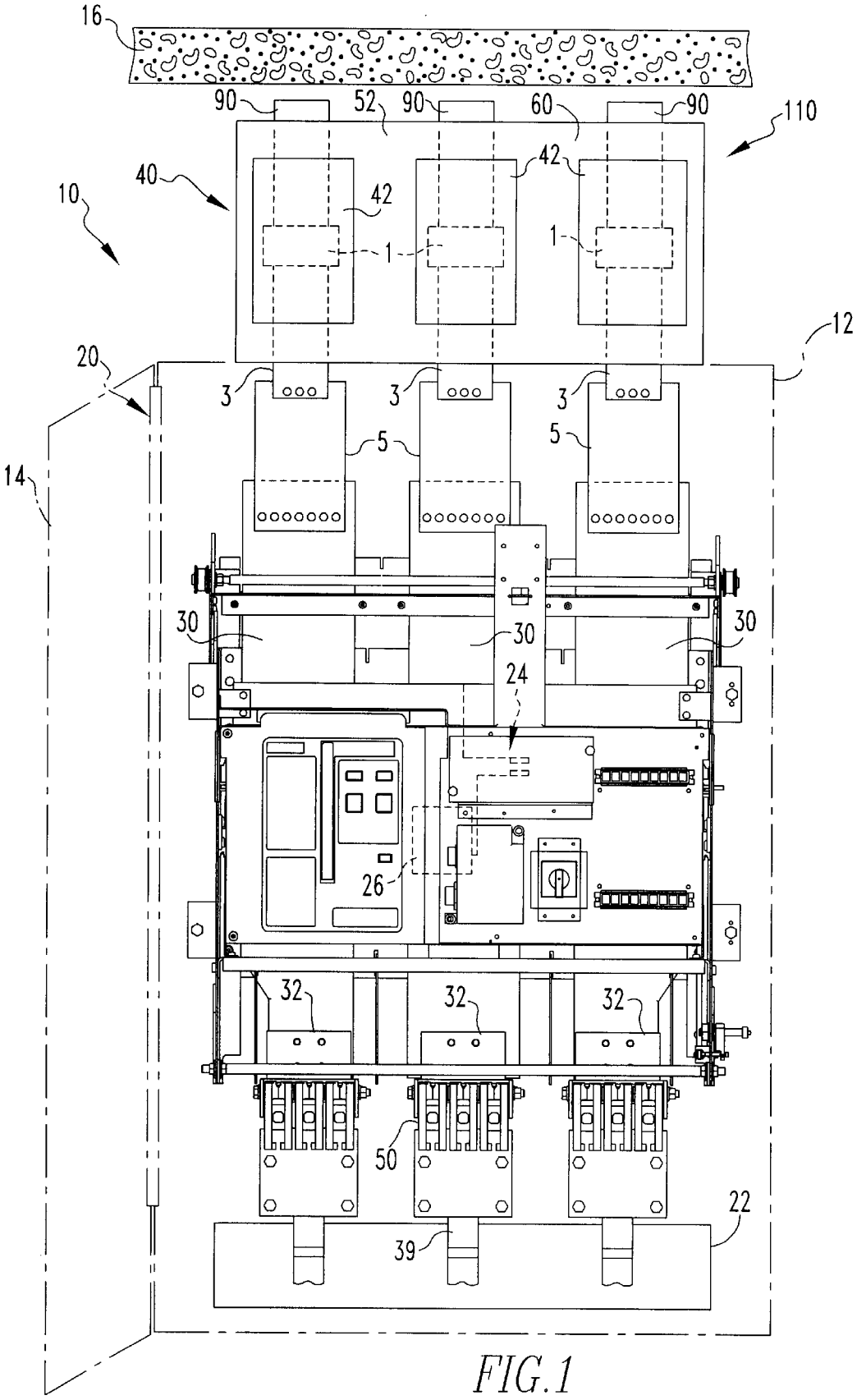
FIG. 1 is a front view of a network protector.

As shown in FIG. 1, a network protector 10 includes a tank 12 which includes a movable door 14. The tank 12 is structured to be placed within a vault 16. A vault is typically made of concrete or a similar material. The two primary network protector components, a circuit breaker 20 and a relay 22 are disposed within the tank 12. The circuit breaker includes at least one set of main contacts 24 (shown schematically) that are structured to move between a first, open position and a second closed position. When the main contacts 24 are in the second, closed, electricity may flow through the circuit breaker 20. When the main contacts 24 are in the first, open position, electricity cannot flow through the circuit breaker 20. The circuit breaker 20 also includes an operating mechanism 26 (shown schematically) that is structured to move the main contacts 24 between the first and second position. The main contacts 24 are coupled to one or more network protector load buses 30 and one or more network protector line buses 32. In a preferred embodiment, shown in FIG. 1, the circuit breaker 20 is a three phase circuit breaker having three poles. Each pole includes a load bus 30 and a line bus 32.

Outside of the tank 12 is a fuse box 110 that includes a plurality of fuse assemblies 1 and a fuse housing assembly 40. There is one fuse assembly 1 coupled to the cable for each pole of the circuit breaker. The fuse assemblies 1 may be coupled to the line side or the load side of the circuit breaker 20. The fuse housing assembly 40 may be attached to the tank 12, or spaced therefrom. As shown in FIG. 1, the fuse housing assembly 40 is coupled to the tank 12. The coupling between the fuse housing assembly 40 and the tank 12 is watertight and may be accomplished by welding the fuse housing assembly 40 to the tank 12.

Figure 2:
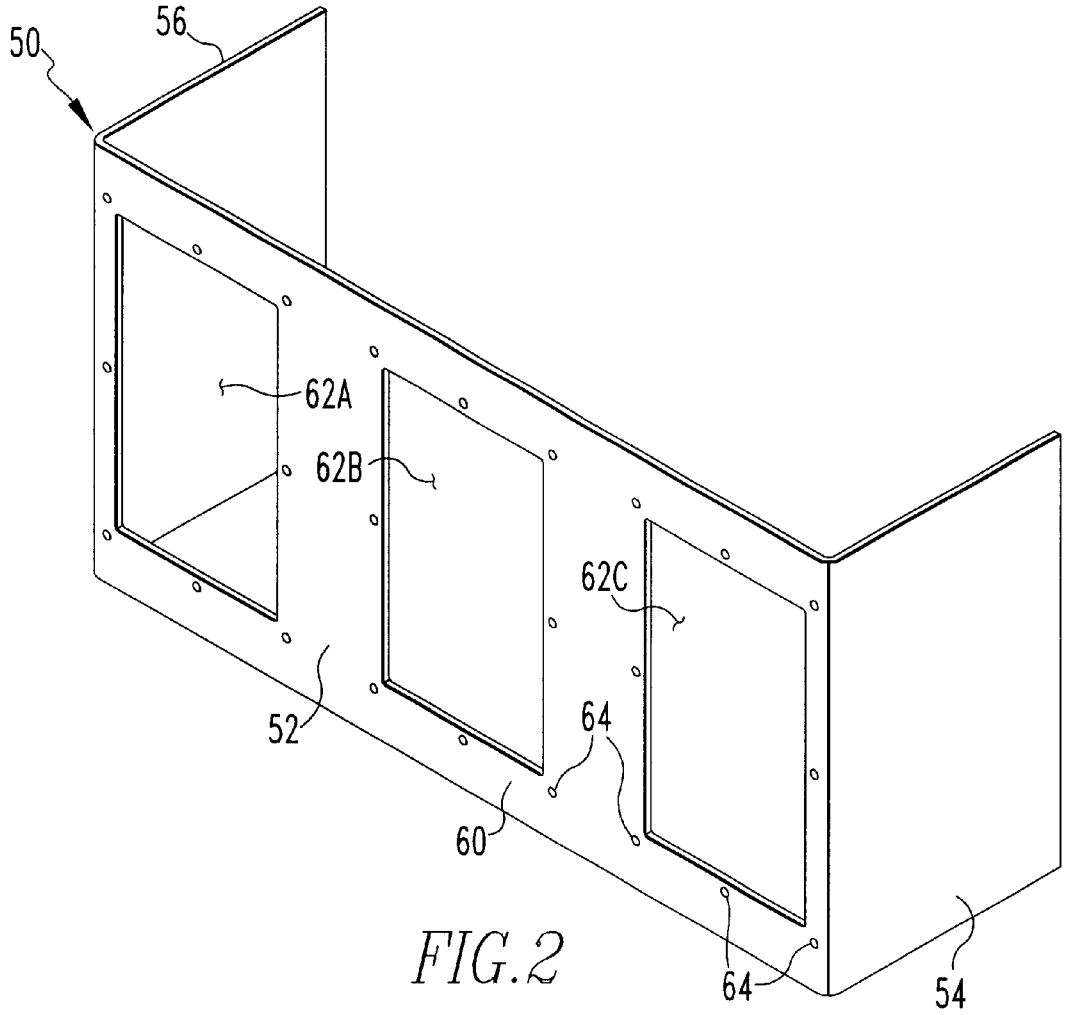
FIG. 2 is an isometric view of the fuse housing first C-shaped body.
Figure 4:
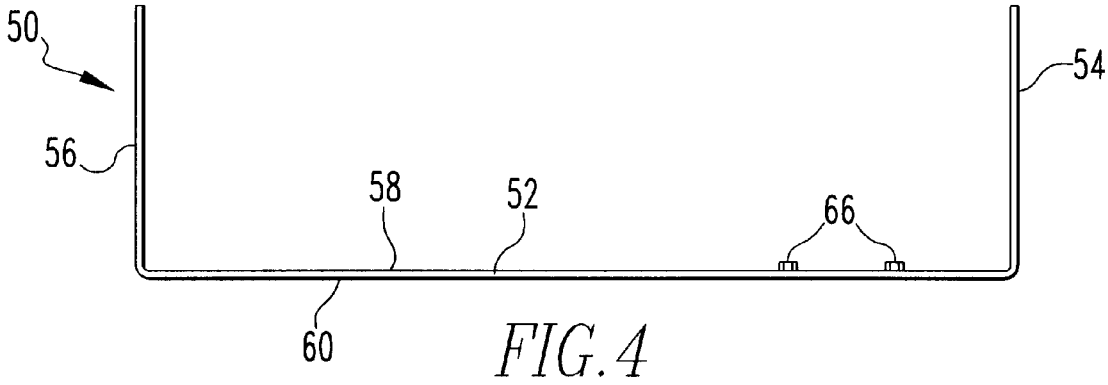
FIG. 4 is a top view of the fuse housing first C-shaped body.
Figure 3:
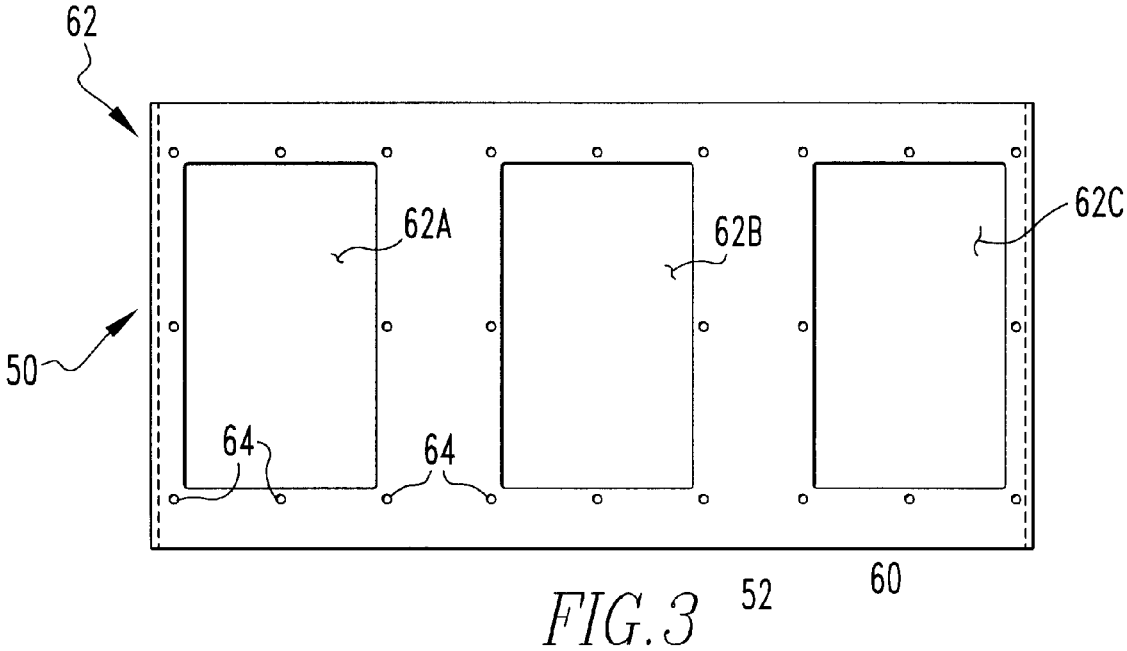
FIG. 3 is a front view of the fuse housing first C-shaped body.
Figure 7:
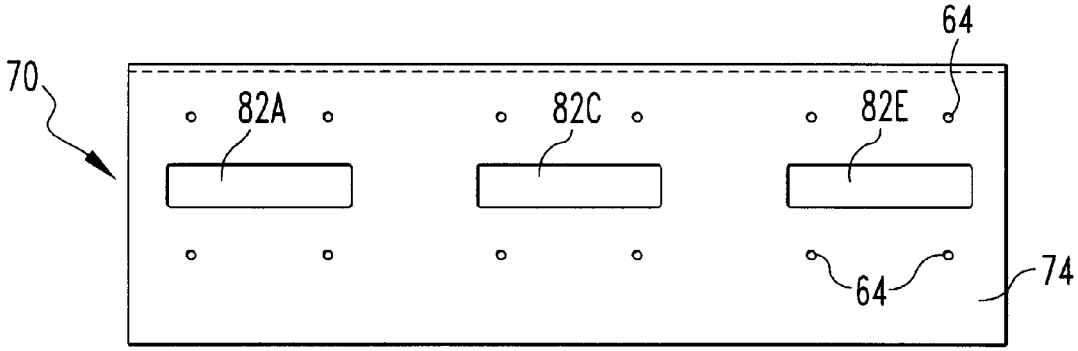
FIG. 7 is a top view of the fuse housing second C-shaped body.
Figure 8:
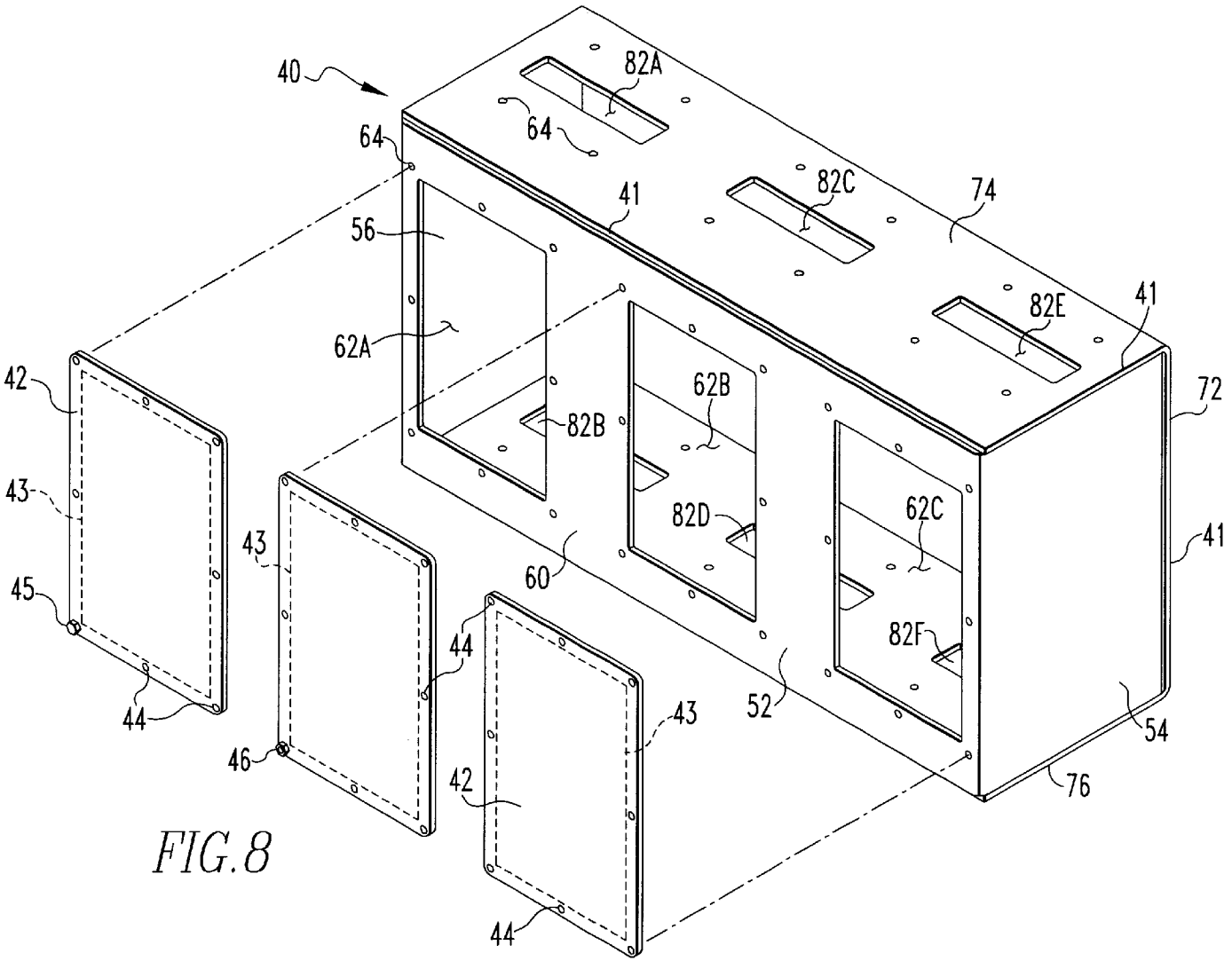
FIG. 8 is a partially exploded isometric view of the fuse housing.
Figure 9:
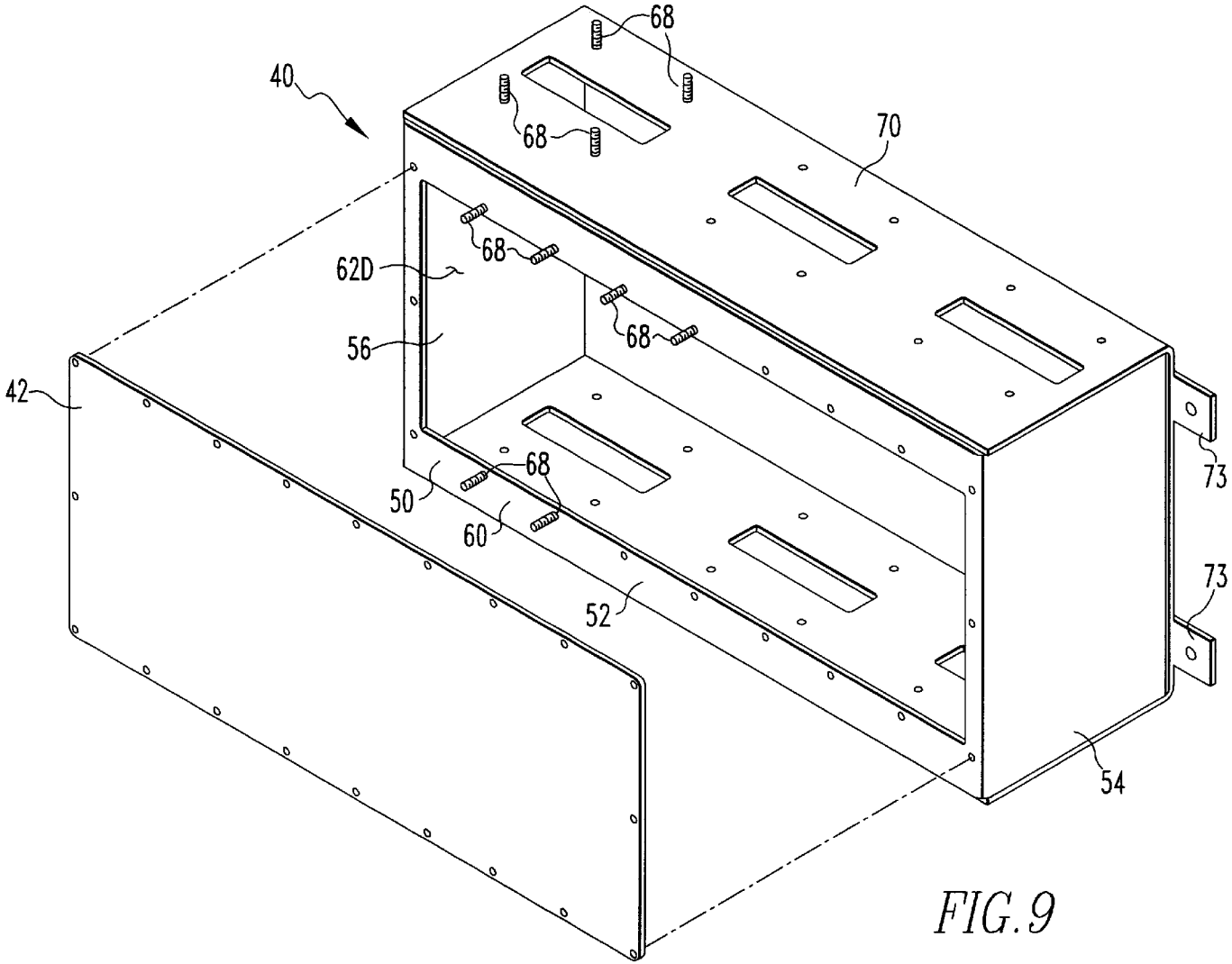
FIG. 9 is a partially exploded isometric view of an alternate fuse housing.

As shown in FIGS. 2–8, the fuse housing assembly 40 includes a first C-shaped body 50 and a second C-shaped body 70. Each C-shaped body 50, 70 is preferably formed from a single flat sheet of metal that has bent extensions as described below. As shown in FIGS. 2–4, the first C-shaped body 50 includes a generally rectangular front side 52 and first and second generally perpendicular extensions 54, 56. The front side has an inner side 58 and an outer side 60. The first and second perpendicular extensions 54, 56 are also generally rectangular and extend in the same direction, one each, from the shorter sides of the rectangular front side 52. The rectangular front side 52 also includes one or more openings 62. There are, preferably three front side openings 62A, 62B, 62C, each sized to allow a network protector fuse assembly body 2 (described below) to pass therethrough. Alternatively, as shown in FIG. 9, there may be a single front side opening 62D spanning a substantial portion of the front side 52. Around the perimeter of the front side openings 62 are a plurality of fastener openings 64. The fastener openings 64 may be threaded, have a nut 66 or similar device attached to the inner side 58. Alternatively, as shown on FIG. 9, the front side opening 62D may have a plurality of threaded rods 68 disposed along the perimeter and extending from the front side outer side 60.

Figure 5:
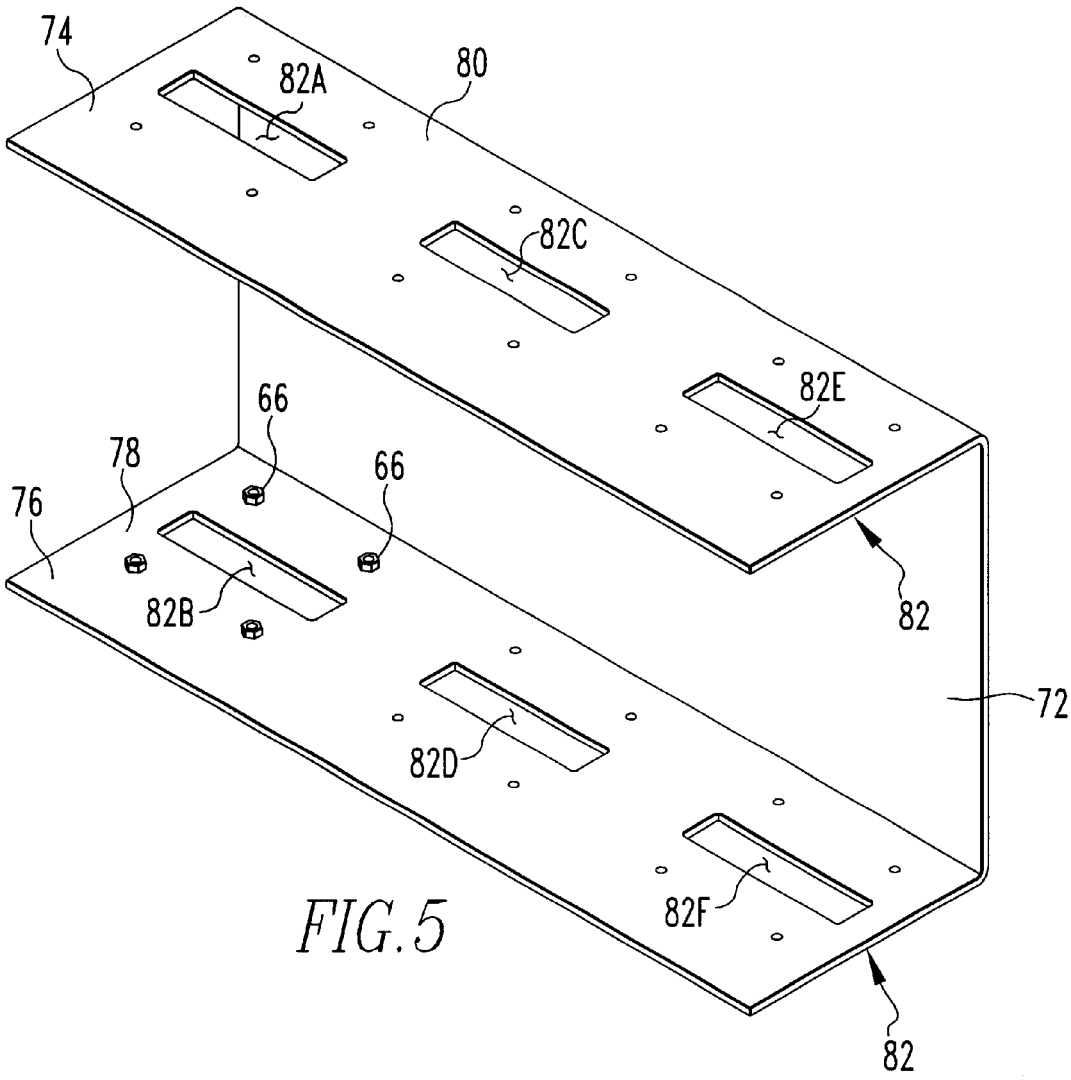
FIG. 5 is an isometric view of the fuse housing second C-shaped body.
Figure 6:
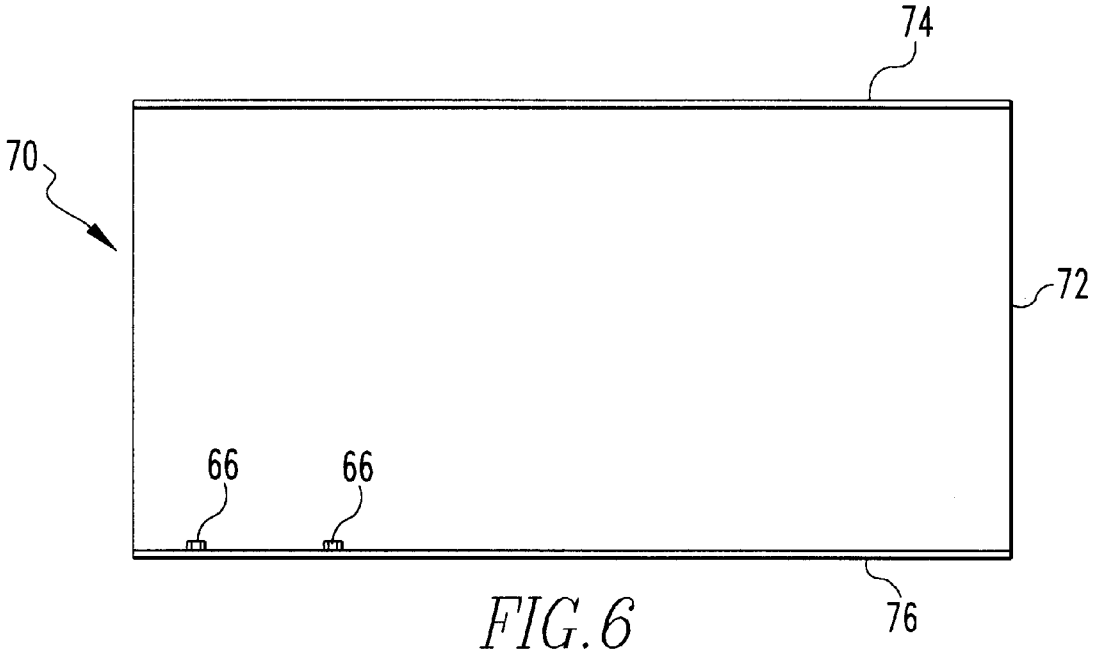
FIG. 6 is a front view of the fuse housing second C-shaped body.

As shown in FIGS. 5–7, the second C-shaped body 70 has a generally rectangular back side 72 and third and fourth generally perpendicular extensions 74, 76. The third and fourth perpendicular extensions 74, 76 each have an inner side 78 and an outer side 80. The third and fourth perpendicular extensions 74, 76 are also generally rectangular and extend in the same direction, one each, from the longer sides of the generally rectangular back side 72. The perpendicular extensions 74, 76 each include two or more openings 72. The third and fourth perpendicular extension openings 82 are disposed in pairs, one opening of the pair on each of the third and fourth perpendicular extensions 74, 76. The third and fourth perpendicular extension openings 82 in each pair are generally aligned. The third and fourth perpendicular extension openings 82 are sized to allow a network protector linking bus 5 (described below) to pass therethrough. Preferably, there are three pairs of third and fourth perpendicular extension openings 82A, 82B, 82C, 82D, 82E, 82F. Around the perimeter of the third and fourth perpendicular extension openings 82 are a plurality of fastener openings 64. The fastener openings 64 may be threaded, have a nut 66 or similar device attached to the inner side 78. Alternatively, as shown on FIG. 9, the third and fourth perpendicular extension openings 82 may have a plurality of threaded rods 68 disposed along the perimeter and extending from the outer side 80. The back side 72 may also include a mounting device such as one or more mounting tabs 73. The mounting tabs extend from the back side 72 and include an opening that allows a fastener to pass therethrough.

The front side 52 and the back side 72 have substantially similar dimensions and have a length sufficient to enclose more than one network protector fuse assemblies 1. Additionally, the first and second perpendicular extensions 54, 56 and the third and fourth perpendicular extensions 74, 76 each extend from the front side 52 and the back side 72, respectively, a substantially similar length. As such, the first C-shaped body 50 and the second C-shaped body 70 are structured to fit together in a clam-shell fashion, as shown in FIG. 8. When the first C-shaped body 50 and the second C-shaped body 70 are fitted together, the distal ends of the first and second perpendicular extensions 54, 56 contact, or are immediately adjacent to, the short sides of the back side 72. Similarly, when the first C-shaped body 50 and the second C-shaped body 70 are fitted together, the distal ends of the third and fourth perpendicular extensions 74, 76 contact, or are immediately adjacent to, the long sides of the front side 52. Therefore, the first C-shaped body 50 and the second C-shaped body 70 may be welded together to form the fuse housing assembly 40. The welded seam 41 extending along the perimeters of the first C-shaped body 50 and the second C-shaped body 70 is, essentially, watertight.

The fuse housing assembly 40 further includes two or more cover plates 42 structured to fit over the front side opening 62. Thus, when there are three front side openings 62A, 62B, 62C, there are also three cover plates 42A, 42B, 42C. The cover plate 42 includes a seal 43 structured to engage the front side outer side 60. The cover plate 42 further includes fastener openings 44 that are spaced to align with the front side fastener openings 62 or threaded rods 68. The cover plates 42 are coupled to the front side 52 by a fastener device 45, for example a bolt 46 or a nut 47 (FIG. 9).

Figure 10:
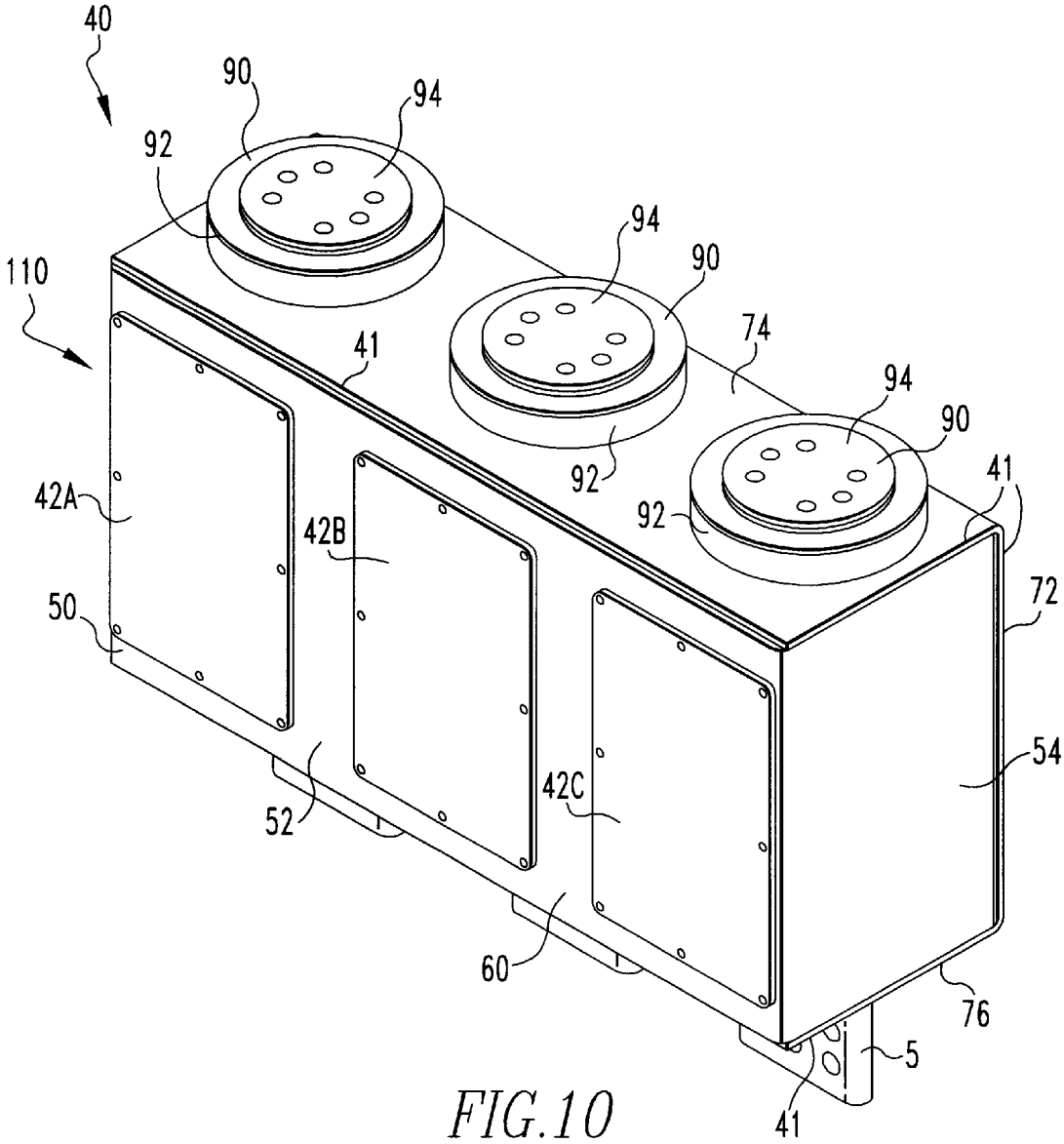
FIG. 10 is a isometric view of a fuse box.
Figure 11:
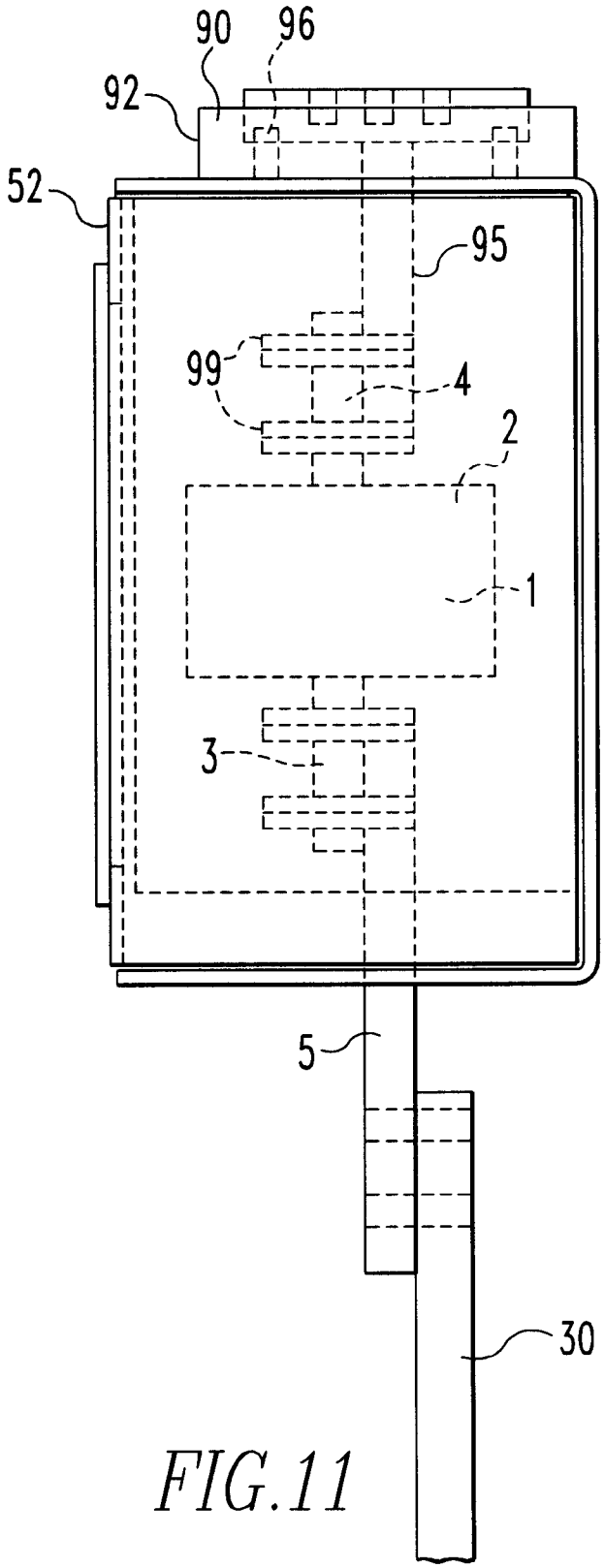
FIG. 11 is a cross-sectional view of the fuse box.
Figure 12:
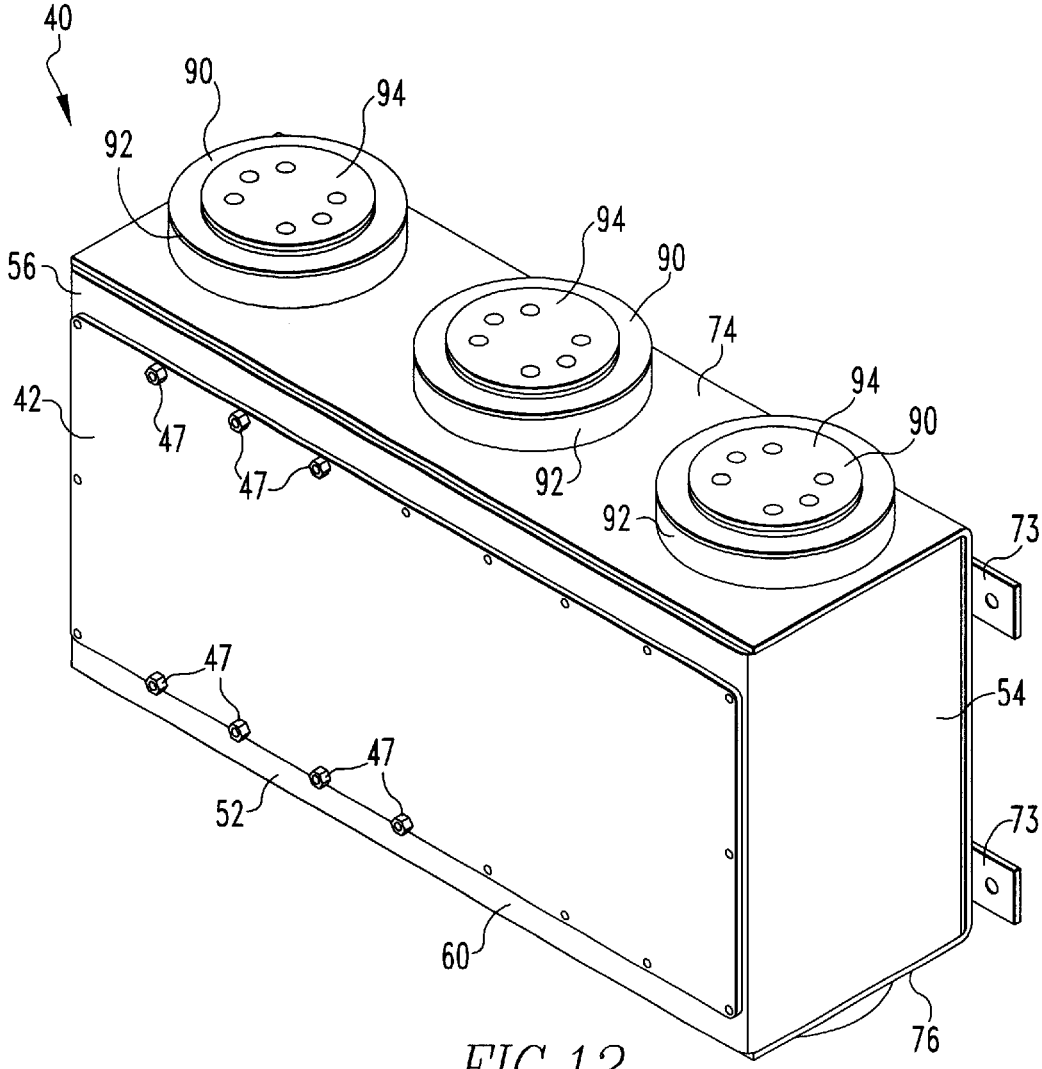
FIG. 12 is a isometric view of an alternate fuse box.

As shown in FIGS. 10 and 11, the fuse housing assembly 40 further includes two or more cable coupling assemblies 90. The cable coupling assemblies 90 include a collar assembly 92, a cable interface 94, and a fuse bus 95 (FIG. 11). The cable coupling assembly fuse bus 95 has a coupling device, for example, a plurality of rods, structured to cooperate and couple with the bus on the fuse assembly (described below). The collar assembly 92 includes an attachment device, such as, but not limited to, one or more bolts 96 or nuts 98. The bolts are structured to engage the third and fourth perpendicular extension fastener openings 64 or threaded rods 68. If the fuse housing assembly 40 is to be attached to the network protector tank, there are cable coupling assemblies 90 located on the side of the fuse housing assembly 40 opposite the network protector tank 12. If the fuse housing assembly 40 is to be attached to a location other than the tank 12, e.g. the vault 16 wall, there are cable coupling assemblies 90 located on both the third and fourth perpendicular extensions 74, 76, as shown in FIGS. 12 and 13.

As stated above, the fuse housing assembly 40 may be coupled to the tank 12, as shown in FIG. 1, or spaced from the tank 12. When the fuse housing assembly 40 is coupled to the tank 12, the fuse housing assembly 40 is, preferably, welded to the tank at the point where the line or load buses exit the tank 12. That is, the line or load bus will extend in to the fuse housing assembly 40. If the fuse housing assembly 40 is not coupled to the tank 12, the tank 12 includes a cable coupling assembly, similar to those described above, coupled to each line or load bus.

Figure 13:
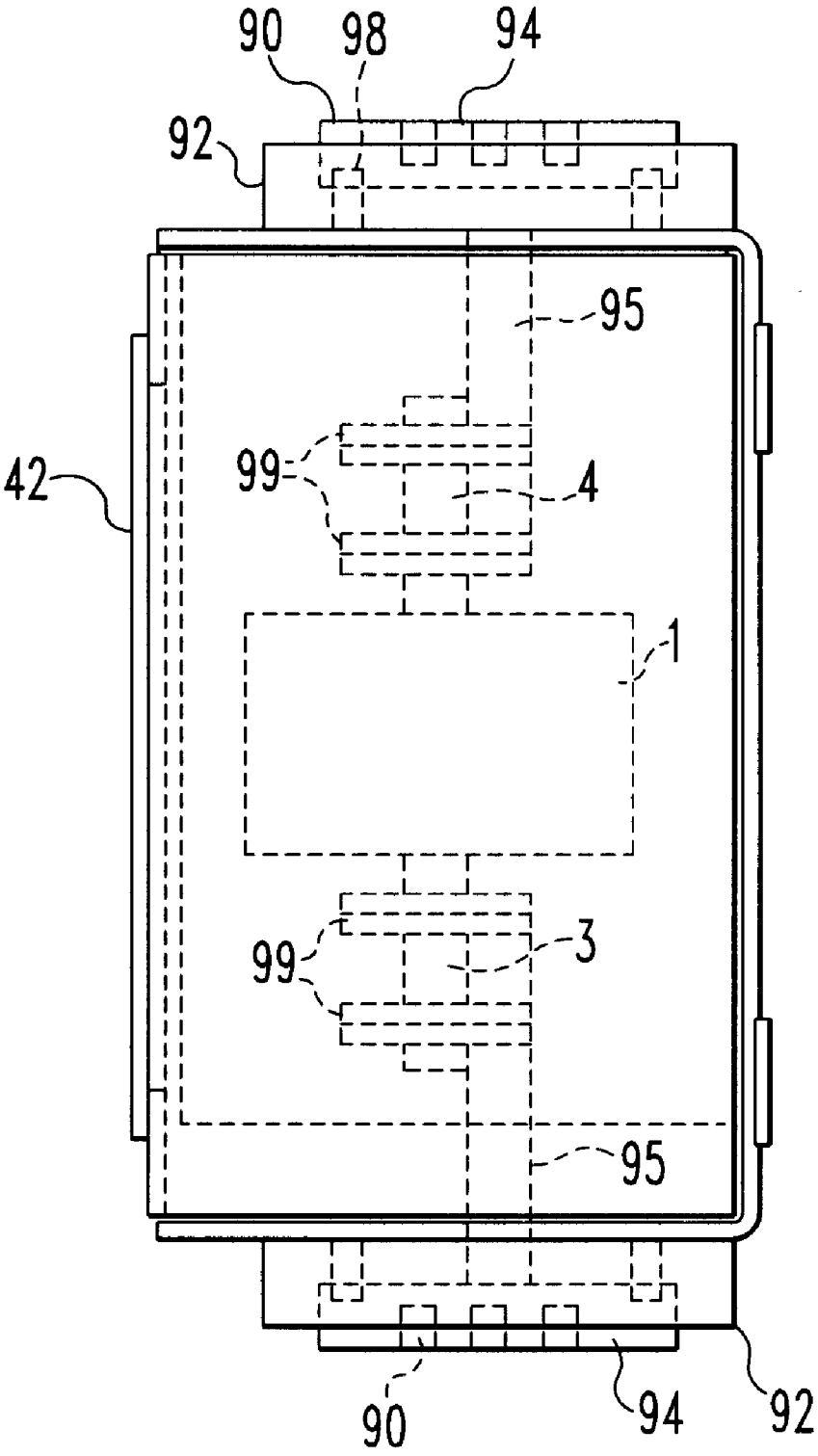
FIG. 13 is a cross-sectional view of the alternate fuse box.

Accordingly, as shown in FIGS. 11, and 13, the fuse housing assembly 40 is structured to enclose two or more network protector fuse assemblies 1. The network protector fuse assembly includes a body 2 that encloses the functional fuse element (not shown), a first bus 3 and a second bus 4. The first bus 3 is structured to be coupled to, and in electrical communication with, a network protector linking bus 5. The linking bus 5 is further coupled to the network protector bus 30, 32 by an attachment device, such as a plurality of cooperating rods and openings. The second bus 4 also includes an attachment device and is structured to be coupled to, and in electrical communication with, the collar assembly fuse bus 95. If the fuse housing assembly 40 is to be attached to a location other than the tank, both the first and second fuse buses 3, 4 may be coupled to a collar assembly fuse bus 95 as shown in FIG. 13.

Thus, as shown in FIG. 1, a fuse box 110, which incorporates the fuse housing assembly 40 and one or more fuse assemblies 1 disposed therein, may be coupled to a tank 12 or mounted at a location other than the tank 12. To access the fuse box 110, a user removes the fasteners on the cover plates 42, and then removes the cover plates 42. The fuse assembly 1 is then placed in the fuse housing assembly 40 and coupled to the network protector bus 30, 32 and the collar assembly fuse bus 95. After the fuse assembly 1 is installed, the cover plate 12 is reattached.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A housing assembly for network protector fuses comprising:

a first C-shaped body having a generally flat, rectangular front side and generally perpendicular first extension and second extension;

a second C-shaped body having a generally flat, rectangular back side and generally perpendicular third extension and fourth;

said first and second C-shaped bodies coupled together forming an enclosure;

said first body having one or more openings on said front side;

one or more cover plates coupled to said first C-shaped body and sealingly disposed over said first body one or more openings; and wherein said front side and said back side have a length sufficient to enclose more than one network protector fuses.

2. The housing assembly of claim 1, wherein said front side and said back side have a substantially similar length;

said first extension and second extension extending from the short sides of said front side;

said third extension and fourth extension extending from the long sides of said back side; and each of said first and second extensions and said third and fourth extensions extending from said front side and said back side, respectively, a substantially similar length.

3. The housing assembly of claim 2, wherein said C-shaped first body and said second C-shaped body are coupled together in a watertight manner.

4. The housing assembly of claim 3, wherein said first C-shaped body and C-shaped second body are coupled together by welding.

5. The housing assembly of claim 2, wherein said second C-shaped body has two or more pairs of aligned openings; and one opening of each pair is disposed on each of said third and fourth extensions.

6. The housing assembly of claim 5, wherein said front side includes three openings; and said second C-shaped body has three pairs of aligned openings.

7. The housing assembly of claim 1, wherein said second C-shaped body includes a mounting device.

8. The housing assembly of claim 7, wherein said mounting device is a plurality of tabs having fastener openings therethrough.

9. A fuse box for a network protector fuses comprising:

a first C-shaped body having a generally flat, rectangular front side and generally perpendicular first extension and second extension;

a second C-shaped body having a generally flat, rectangular back side and generally perpendicular third extension and fourth;

wherein said front side and said back side have a length sufficient to enclose three network protector fuses;

said first and second C-shaped bodies coupled together forming an enclosure;

said first C-shaped body having one or more openings on said front side;

said second C-shaped body has two or more pairs of aligned openings wherein one opening of each pair is disposed on each of said third and fourth extensions;

two or more cable coupling assemblies having a collar assembly, a cable interface, and a fuse bus;

said collar assembly sealingly engaging said second C-shaped body;

said fuse bus extending through one of said pair of third and fourth extension openings;

at least one fuse assembly having a body, a first buss and a second bus;

said at least one fuse assembly disposed in said enclosure with said second bus coupled to said fuse bus; and one or more cover plates coupled to said first C-shaped body and sealingly disposed over said first body one or more openings.

10. The fuse box of claim 9, wherein said front side and said back side have a substantially similar length;

said first extension and second extension extending from the short sides of said front side;

said third extension and fourth extension extending from the long sides of said back side; and each of said first and second extensions and said third and fourth extensions extending from said front side and said back side, respectively, a substantially similar length.

11. The fuse box of claim 10, wherein said C-shaped first body and said second C-shaped body are coupled together in a watertight manner.

12. The fuse box of claim 11, wherein said first C-shaped body and C-shaped second body are coupled together by welding.

13. The fuse box of claim 10, wherein said front side includes three openings; and said second C-shaped body has three pairs of aligned openings.

14. The fuse box of claim 9, wherein said second C-shaped body includes a mounting device.

15. The fuse box of claim 14, wherein said mounting device is a plurality of tabs having fastener openings therethrough.

16. A network protector comprising:

a tank;

a circuit breaker disposed within said tank and having a plurality of line and load buses;

a fuse box attached to said tank;

said fuse box comprising:

a first C-shaped body having a generally flat, rectangular front side and generally perpendicular first extension and second extension;

a second C-shaped body having a generally flat, rectangular back side and generally perpendicular third extension and fourth;

wherein said front side and said back side have a length sufficient to enclose three network protector fuses;

said first and second C-shaped bodies coupled together forming an enclosure;

said first C-shaped body having one or more openings on said front side;

said second C-shaped body has two or more pairs of aligned openings wherein one opening of each pair is disposed on each of said third and fourth extensions;

two or more cable coupling assemblies having a collar assembly, a cable interface, and a fuse bus;

said collar assembly sealingly engaging said second C-shaped body;

said fuse bus extending through one of said pair of third and fourth extension openings;

at least one fuse assembly having a body, a first buss and a second bus;

said at least one fuse assembly disposed in said enclousre with said second bus coupled to said fuse bus and said first bus coupled to one of said circuit breaker plurality of buses; and one or more cover plates coupled to said first C-shaped body and sealingly disposed over said first body one or more openings.

17. The fuse box of claim 16, wherein said front side and said back side have a substantially similar length;

said first extension and second extension extending from the short sides of said front side;

said third extension and fourth extension extending from the long sides of said back side; and each of said first and second extensions and said third and fourth extensions extending from said front side and said back side, respectively, a substantially similar length.

18. The fuse box of claim 17, wherein said C-shaped first body and said second C-shaped body are coupled together in a watertight manner.

19. The fuse box of claim 18, wherein said first C-shaped body and C-shaped second body are coupled together by welding.

20. The fuse box of claim 16, wherein said front side includes three openings; and said second C-shaped body has three pairs of aligned openings.

* * * * *